United States Patent [19]

Thomann

[11] Patent Number: 4,949,512

[45] Date of Patent: Aug. 21, 1990

[54] CAGE FOR RECONDITIONING BUILDING FACADES

[76] Inventor: Gabrielle Thomann, 123bis, boulevard Exelmans, 75016 Paris, France

[21] Appl. No.: 265,743

[22] Filed: Nov. 1, 1988

[30] Foreign Application Priority Data

Nov. 3, 1987 [FR] France ..... 87 15213

[51] Int. Cl.[5] ..... B24C 9/00

[52] U.S. Cl. ..... 51/426; 51/424

[58] Field of Search ..... 51/180, 270, 424, 426, 51/417, 418, 419, 421; 98/115.4

[56] References Cited

U.S. PATENT DOCUMENTS 3,977,128 8/1976 Goff ..... 51/424

FOREIGN PATENT DOCUMENTS 004496 3/1977 Japan ..... 51/424

*Primary Examiner*—D. S. Meislin

*Assistant Examiner*—Jack W. Lavinder

*Attorney, Agent, or Firm*—Pollock, Vande Sande and Priddy

[57] ABSTRACT

A cage for reconditioning builidng facades includes rear, bottom, top and side walls which form a partially enclosed region in which persons doing the reconditioning may be located. The top, bottom and side walls define an open front of the cage that is intended to be disposed closely adjacent to a facade to be reconditioned, and each of these walls includes an air flow slot that is oriented toward the facade and cooperates with an air blower to produce an air jet oriented in a direction substantially perpendicular to the facade to form an air curtain adjacent to and surrounding the open front of the cage.

9 Claims, 1 Drawing Sheet

CAGE FOR RECONDITIONING BUILDING FACADES

The invention relates to a cage or cabin for the reconditioning of building facades.

Cages (see FIG. 1) are already known which are secured to the end of the lifting arm of a crane and which are applied at the open front side 1 against the facade to be reconditioned. The operatives stand on the floor 2 of this cage and, by means of sand-blasting nozzles, they clean the area of the facade bounded by the opening 1.

The rear side 3 of this cage is provided with ventilators 4 which are combined with filtering elements and which serve to exhaust the air laden with sand in suspension so as to filter it and then discharge it.

It is already known to provide an inflatable tube 5 on the periphery of the cage opening 1 so that this tube is applied against the building facade, thereby ensuring a better seal and without any danger of damaging projecting ornamental elements which may be present on this facade.

However, despite the presence of this peripheral inflatable tube, it appears that a satisfactory seal is not ensured with the result that air laden with sand particles is discharged to the exterior, which is harmful to the environment.

In particular, it is aim of the present invention to obviate these drawbacks and, for this purpose, the invention relates to a cage for the reconditioning of building facades, said cage comprising an open front side intended to be placed aginst the facade to be reconditioned, which cage is characterised in that the periphery of the open front side has means for producing an air curtain directed towards the facade to be reconditioned.

According to another feature of the invention, the walls of the cage defining the opening of the front side are formed at least partly by inflatable tubes.

According to another feature of the invention, the inflatable tubes defining the walls of the cage are provided, on the inner side of the cage, with a flexible partition which defines with the inflatable tubes an air flow slot forming the air curtain.

The invention is illustrated non-restrictively by way of example in the accompanying drawings, in which.

Figure 1:
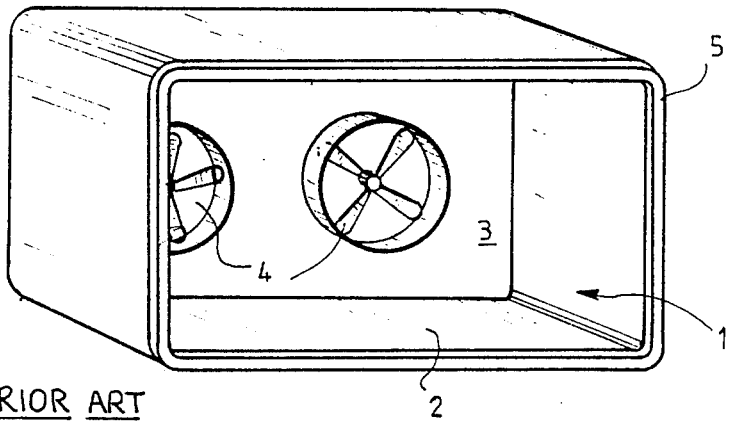
FIG. 1 is diagrammatic view in perspective of a reconditioning cage of known type.
Figure 2:
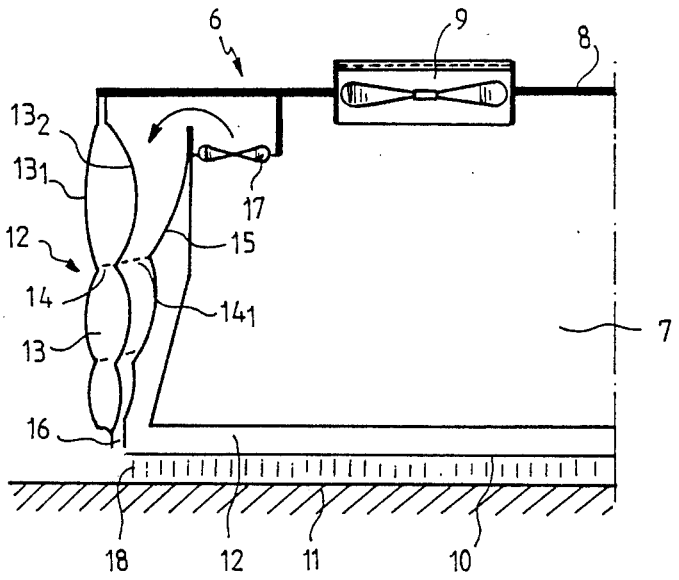
PRIOR ART FIG.2
FIG. 2 is a cross-sectional view of part of a cage according to the invention.

The present invention has the aim of devising a cage for the reconditioning of facades, which makes it possible to prevent air laden with sand in suspension from escaping at the periphery of the cage opening. As shown in FIG. 2 the cage 6 of the present invention comprises a floor 7 on which the operatives stand, a rear side 8 provided with at least one exhaust and filtration assembly 9, a front side 10 which is positioned against or at least close to the facade 11 of the building to be reconditioned, and walls 12 defining two side walls, an upper wall and a lower wall situated below the floor 7.

These walls 12 take the form of an inflatable element 13 comprising either separate compartments inflatable independently of one another or a single compartment and, in this case, cables 14 are provided on the inside of the element so that the two sides $13_1$, $13_2$ of the element 13 are maintained parallel to each another.

A flexible wall 15 is provided inside the inflatable element 13 and it defines with the front edge of the element 13 a slot 16. This flexible wall 15 is maintained in position relative to the inflatable element 13 by means of cables $14_1$ which, preferably, are extensions of the cables 14. In the rear zone of the cage there is provided a fan 17 which creates an air jet passing between the wall 15 and the element 13 so as to produce, through the slot 16, an air curtain 18 directed against the building facade 11 in surrounding relation to the open front of the cage. The effect of this air curtain is to prevent the direct egress of air at the periphery of the cage but, instead, to induce this air laden with sand to be directed towards the exhaust assembly 9.

This air curtain is directed perpendicularly to the facade 11 but, preferably, it is slightly inclined towards the interior so as to be more effectively opposed to the jet of air laden with sand created by the blasting nozzles after the air and sand have impinged against the facade undergoing reconditioning.

In the embodiment illustrated the walls 12 define the full depth of the cage. However, it is to be understood that, if considered sufficient, the inflatable element 13 and flexible wall 15 could be provided on one portion of the depth of the cage, the critical factor being that the shape of the cage periphery can adapt to any unevenness in the building facade and can be positioned against the building or at least at sufficiently little distance therefrom to enable the air curtain to prevent the egress of air laden with sand particles.

I claim:

1. A cage for the reconditioning of building facades, said cage comprising an open front intended to be placed against the facade to be reconditioned, the periphery of the open front of said cage having means for producing an air curtain that surrounds the open front of the cage and is directed towards the facade to be reconditioned in a direction substantially perpendicular to said facade to prevent the reconditioning material from escaping to the environment.

2. A cage according to claim 1, characterised in that the walls of the cage defining the open front of said cage are formed at least partly by inflatable tubes (13).

3. A cage according to claim 2, characterized in that the inflatable tubes defining said walls of the cage are provided, on the interior of the cage, with a flexible partition which defines with the inflatable tubes an air flow slot which faces the facade and forms the air curtain.

4. A cage for the reconditioning of building facades comprising a floor within said cage upon which persons may stand, a bottom wall below said floor, an upper wall above said floor, and side walls interconnecting said bottom wall and said upper wall to form a partially enclosed region in which persons standing on said floor may be located, said walls defining an open front of said cage that is intended to be disposed closely adjacent to a facade to be reconditioned, each of said walls including an air flow slot that is oriented toward said facade, and an air blower communicating with said slots for producing an air jet that emerges from said slots toward said facade in a direction substantially perpendicular to said facade to form an air curtain adjacent the open front of said cage in surrounding relation to the front end of said partially enclosed region.

5. The cage of claim 4 wherein said air flow slots are so oriented that the direction of said air jet emerging from said slots is slightly inclined toward the interior of said cage.

6. The cage of claim 4 wherein said cage includes a rear wall that is provided with at least one exhaust and filtration assembly for effecting a flow of air from the interior of said cage to the exterior of said cage in a direction substantially opposite to the direction of air flow in said air jet.

7. The cage of claim 6 wherein said air blower is located within said cage, and means within said cage for directing air from said blower to ends of said air flow slots remote from said facade.

8. The cage of claim 7 wherein each of said upper, bottom and side walls is defined by at least one inflatable tube that extends between said rear wall and said open front of said cage.

9. The cage of claim 8 wherein said air flow slots are defined by a flexible partition that is disposed in spaced relation to surfaces of said inflatable tubes which face the interior of said cage.

* * * * *